US007195146B1

(12) United States Patent
Dunn et al.

(10) Patent No.: US 7,195,146 B1
(45) Date of Patent: Mar. 27, 2007

(54) DEFLECTOR MAILBOX SUPPORT SYSTEM

(76) Inventors: Tristram C. Dunn, 4 Walmsey Rd., Darien, CT (US) 06820; George E. Riehm, 110 Gillotti Rd., New Fairfield, CT (US) 06812

( * ) Notice: Subject to any disclaimer, the term of this patent is extended or adjusted under 35 U.S.C. 154(b) by 0 days.

(21) Appl. No.: 11/327,002

(22) Filed: Jan. 6, 2006

(51) Int. Cl.
*A47G 29/12* (2006.01)

(52) U.S. Cl. ..... 232/39; 248/417; 248/418; 248/131

(58) Field of Classification Search ..... 232/39, 232/38, 17; 248/417, 418, 131, 145, 125.7, 248/219.2; D99/32
See application file for complete search history.

(56) References Cited

U.S. PATENT DOCUMENTS

| | | | | | |
|---|---|---|---|---|---|
| 697,450 | A | * | 4/1902 | Corbin | 232/17 |
| 885,460 | A | * | 4/1908 | Felknor | 248/131 |
| 1,240,190 | A | * | 9/1917 | Forth | 248/131 |
| 2,911,174 | A | * | 11/1959 | Goss | 248/160 |
| 3,407,997 | A | | 10/1968 | Wood et al. | |
| 3,899,150 | A | | 8/1975 | Racquet | |
| 4,508,259 | A | * | 4/1985 | Hicks | 232/17 |
| 4,667,918 | A | * | 5/1987 | Page | 248/418 |
| 4,893,747 | A | * | 1/1990 | Roth | 232/39 |
| 5,356,072 | A | | 10/1994 | Thomas | |
| 5,400,958 | A | * | 3/1995 | Walker | 232/39 |
| 5,458,286 | A | | 10/1995 | Paschal | |
| 5,622,343 | A | | 4/1997 | Morton | |
| 5,699,989 | A | | 12/1997 | Guthrie | |
| 6,047,933 | A | * | 4/2000 | Hoover | 248/219.2 |

* cited by examiner

*Primary Examiner*—William L. Miller
(74) *Attorney, Agent, or Firm*—John H. Crozier

(57) ABSTRACT

In a preferred embodiment, an apparatus, including: a generally horizontal support tray to support a mailbox; a post interface bracket for attachment to a mailbox support post; a spring attached to said generally horizontal support tray and said post interface bracket and disposed so as to return said generally horizontal support tray to its normal position after said generally horizontal support tray is rotated out of position; and a connection pivot bolt connecting said spring and said post interface bracket, said connection bolt being sole method of fixed attachment of said generally horizontal support tray and said post interface bracket.

10 Claims, 12 Drawing Sheets

DEFLECTOR MAILBOX SUPPORT SYSTEM

BACKGROUND OF THE INVENTION

1. Field of the Invention

The present invention relates to mailbox support systems generally, and more particularly, to a mailbox support system that is capable of withstanding blows to the mailbox without appreciable damage to the mailbox.

2. Background Art

Mailboxes of the type that are located near a roadway sustain damage from a variety of sources. Most notably, they sustain damage from vandalism, typically from a baseball bat wielded from a moving vehicle, or they sustain damage from a snowplow throwing snow and ice and hitting the mailbox. In either case, the damaging blow usually comes from the right to the left when facing the opening of the mailbox. When the mailbox is rigidly mounted to the post, the mailbox is more likely to experience permanent and extensive damage from denting if the mailbox is hit.

Some attempts to solve this problem are:

U.S. Pat. No. 3,407,997, issued Oct. 29, 1968, to Wood et al., and titled ROTABLE MAIL BOX, discloses a spring-mounted mailbox that can be rotated so that it assumes a mail-receiving position and can be rotated 180 degrees to a mail-discharging position.

U.S. Pat. No. 3,899,150, issued Aug. 12, 1975, to Racquet, and titled SELF-RIGHTING MAILBOX SUPPORT, discloses a mailbox support that has a coil spring disposed in a vertical member to which the mailbox is horizontally attached. The coil spring returns the mailbox to its normal position after it has been hit.

U.S. Pat. No. 5,356,072, issued Oct. 18, 1994, to Thomas, and titled MAILBOX MOUNTING DEVICE TO ABSORB LATERAL IMPACT, discloses a mailbox that is slidably mounted on nails which are enclosed by springs. When the mailbox is hit by a moving object, the mailbox slides and is returned to its normal position by means of the springs.

U.S. Pat. No. 5,458,286, issued Oct. 17, 1995, to Paschal, and titled ROTATABLE MAILBOX MOUNTING ASSEMBLY, discloses a mailbox support system which allows the mailbox to be rotated 360 degrees in either direction. The support consists of a spring and detent balls. The intent of the device is to allow one to rotate the mailbox 180 degrees, thus obviating the need to enter to road on which the mailbox is mounted.

U.S. Pat. No. 5,622,343, issued Apr. 22, 1997, to Morton, and titled MAIL BOX MOUNTING DEVICE, discloses a mailbox support that has a lower member that is attached to the post of the mailbox. An upper member is rotatably attached to the lower member so that the upper member can be rotated such that mail can be retrieved from other than the roadway. A spring and detents are provided to return the mailbox to any desired position.

U.S. Pat. No. 5,699,989, issued Dec. 23, 1997, to Guthrie, and titled MAILBOX MOUNTING DEVICE WHICH RETURNS TO ITS ORIGINAL POSITION AFTER SIDE IMPACT, discloses a mailbox mounting which includes a rotatable upper member mounted on a fixed lower member. The upper member is prevented from moving more that 90 degrees with respect to the lower member by two pins. The upper member is returned to its original position by means of two springs.

Accordingly, it is a principal object of the present invention to provide a mailbox support system that eliminates or reduces damage from intentional or unintentional blows to the mailbox.

It is a further object of the invention to provide such a mailbox support system that permits the mailbox to rotate horizontally sideways, rotate upwards, and/or tilt horizontally counterclockwise when it receives a damaging blow.

It is an additional further object of the invention to provide such a mailbox support system that can easily be restored to its original position if rotated out of position.

It is another object of the invention to provide such a mailbox support system that is economically constructed of common materials using conventional techniques.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an apparatus, comprising: a generally horizontal support tray to support a mailbox; a post interface bracket for attachment to a mailbox support post; a spring attached to said generally horizontal support tray and said post interface bracket and disposed so as to return said generally horizontal support tray to its normal position after said generally horizontal support tray is rotated out of position; and a connection pivot bolt connecting said spring and said post interface bracket, said connection bolt being sole method of fixed attachment of said generally horizontal support tray and said post interface bracket.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which:

FIG. 15 FIG. 5 is a top/front/side isometric view of the deflector mailbox support system of the present invention attached to a conventional mailbox and mounted on a standard L-shaped post, with protective hoops attached to the mailbox, and with bracing arms attached to the protective hoops.

DETAILED DESCRIPTION OF THE PREFERRED EMBODIMENTS

Figure 1:
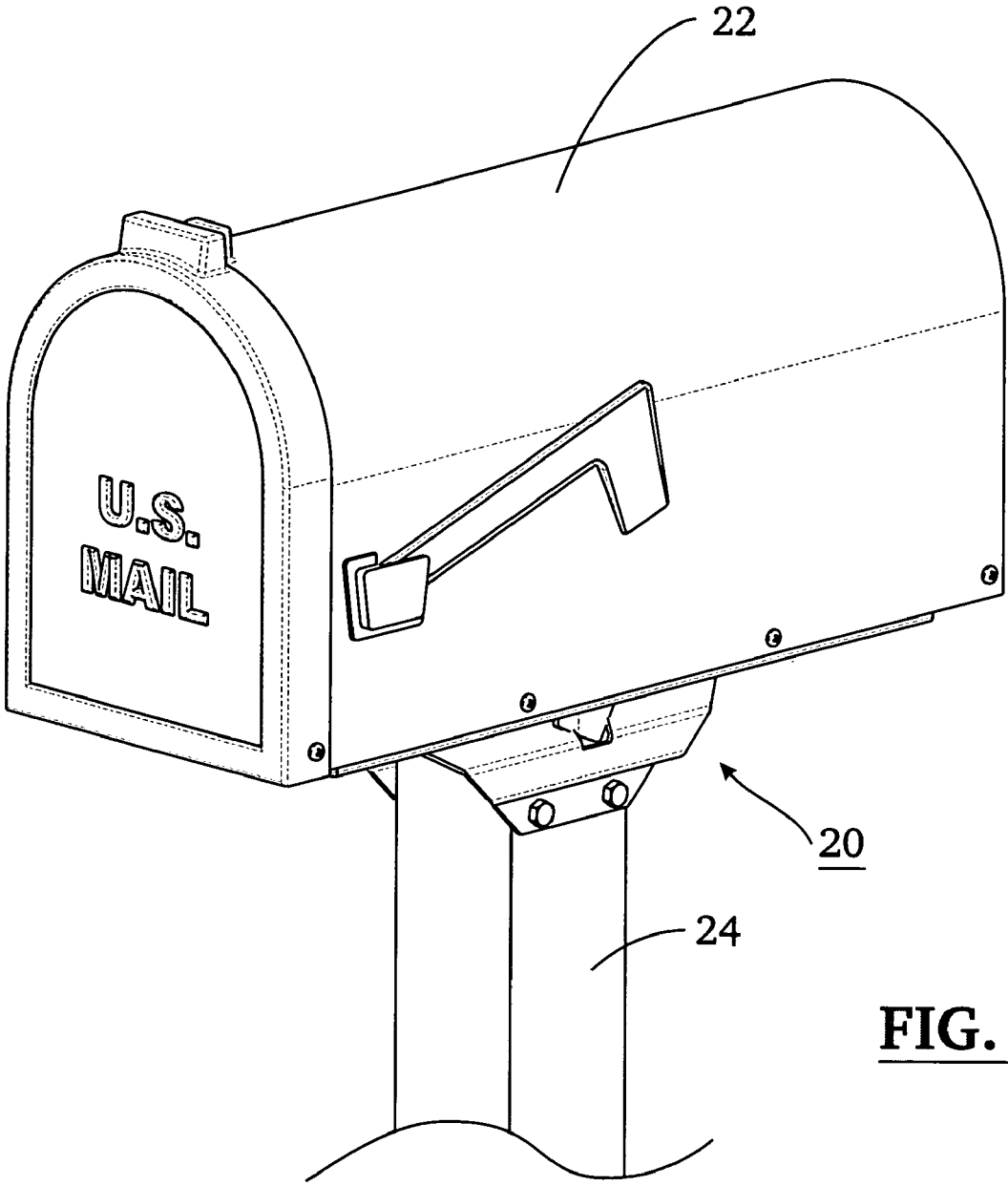
FIG. 1 is a top/front/side isometric view of the deflector mailbox support system of the present invention attached to a conventional mailbox and mounted on a standard vertical post.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

Figure 2:
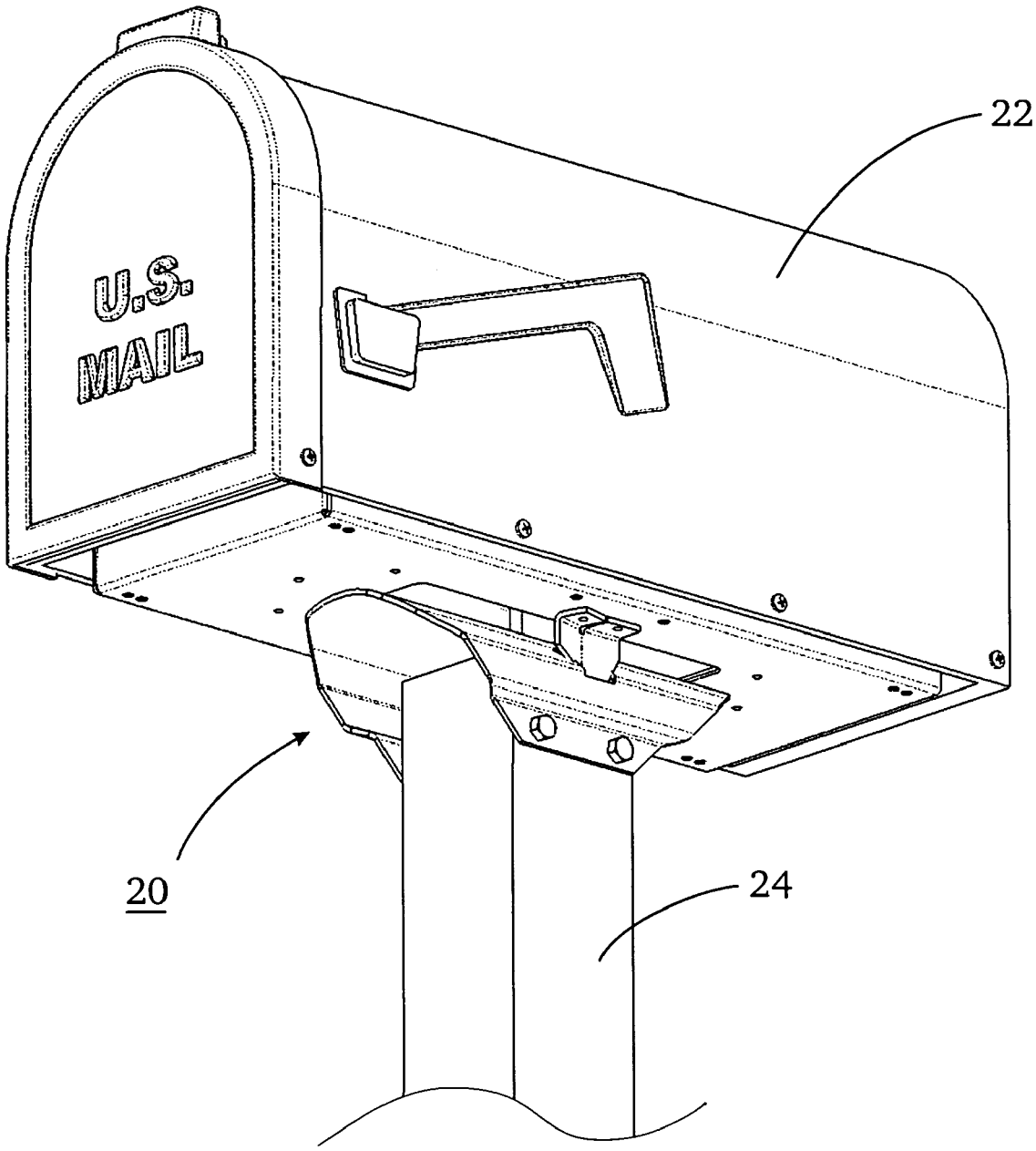
FIG. 2 is a bottom/front/side isometric view of the deflector mailbox support system of FIG. 1.

FIGS. 1 and 2 illustrate a deflector mailbox support system, constructed according to the present invention, and generally indicated by the reference numeral 20. Deflector mailbox support system is attached to a conventional mailbox 22 and is mounted on the top of a standard 4×4 wooden post. Other types of posts may be used as well. Mailbox 22 is preferably constructed of a plastic material, such as polypropylene, but can be constructed of other materials, such as metallic materials, as well.

Figure 3:
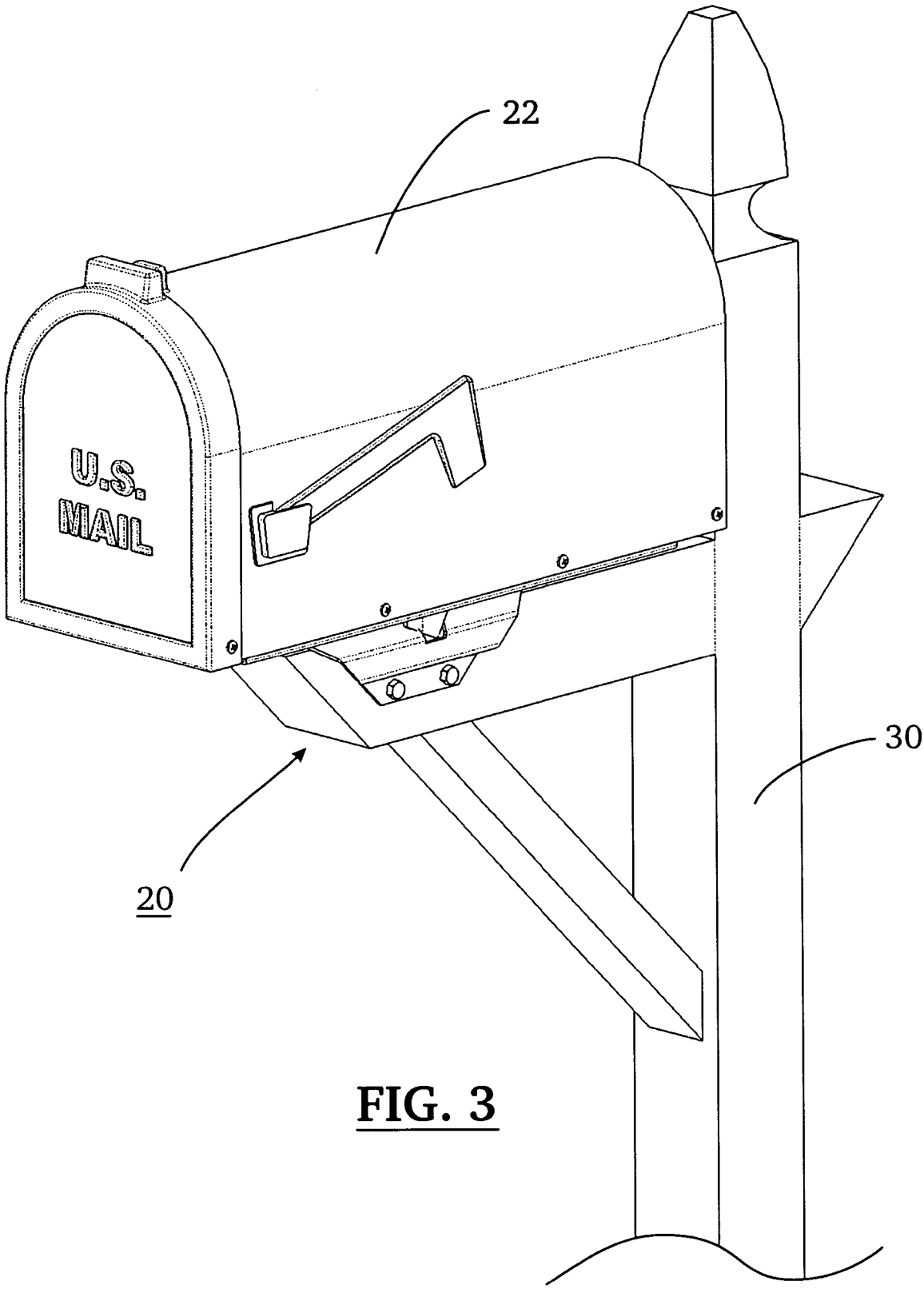
FIG. 3 is a top/front/side isometric view of the deflector mailbox support system of the present invention attached to a conventional mailbox and mounted on a standard L-shaped post.
Figure 4:
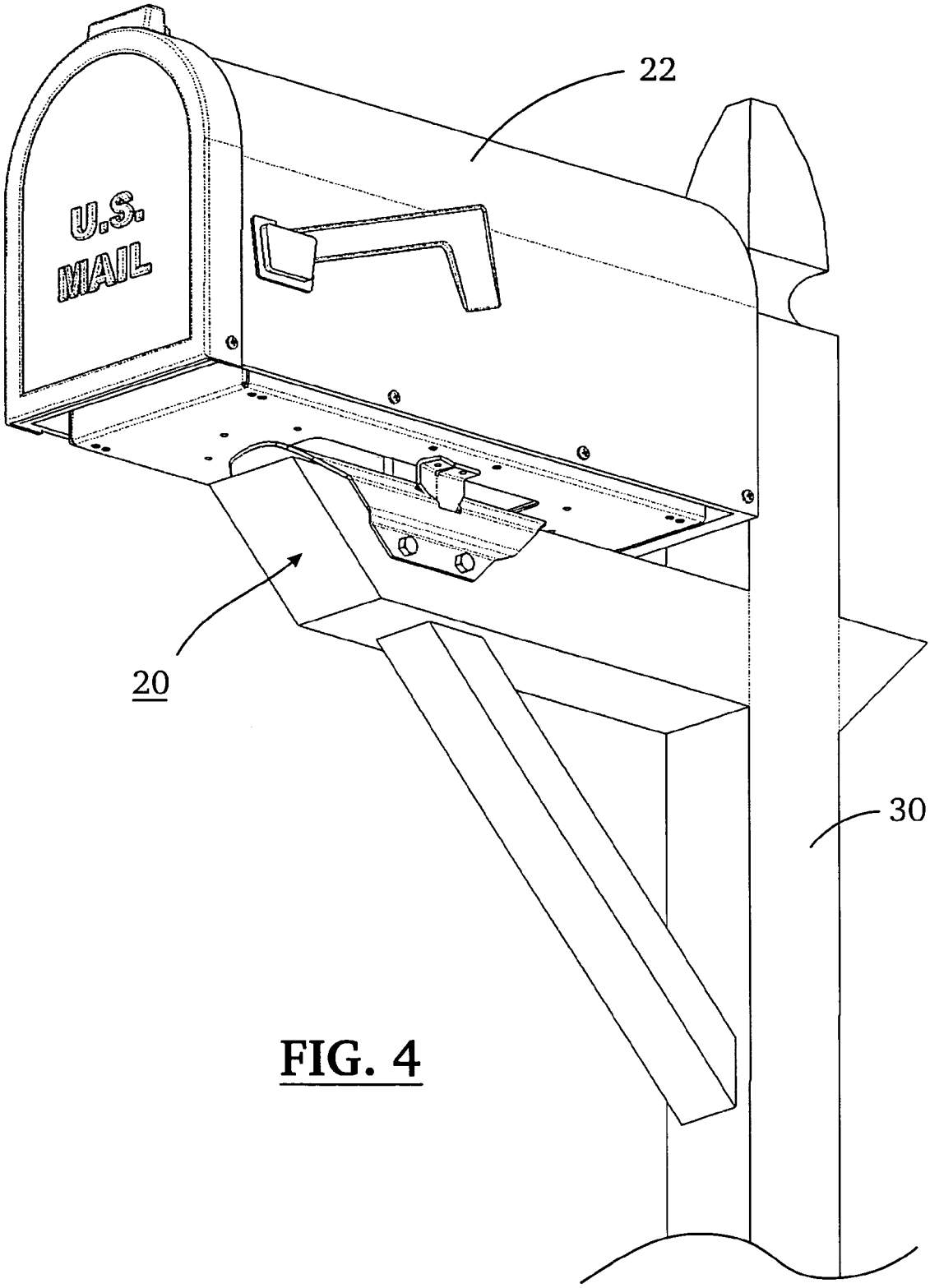
FIG. 4 is a bottom/front/side isometric view of the deflector mailbox support system of FIG. 3.

FIGS. 3 and 4 illustrate the deflector mailbox support system 20 attached to a mailbox 22 and mounted on the lateral arm of an L-shaped 4×4 wooden post. It will be noted that the means of attachment to the post is the same whether it is a straight post (FIGS. 1 and 2) or an L-shaped post as shown.

Figure 5:
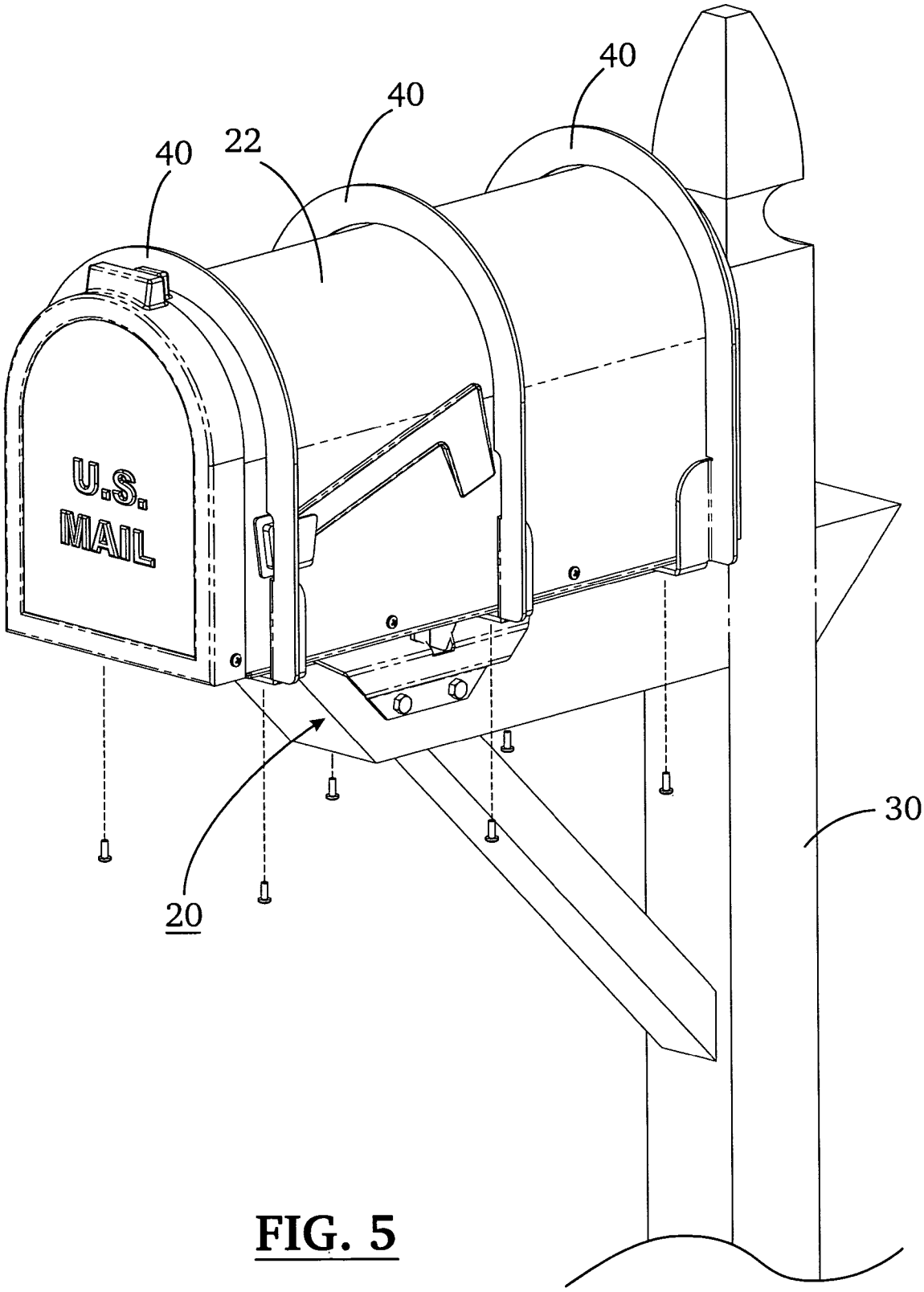
FIG. 5 is a top/front/side isometric view of the deflector mailbox support system of the present invention attached to a conventional mailbox and mounted on a standard L-shaped post, with protective hoops attached to the mailbox.

FIG. 5 illustrates protective hoops, as at 40, attached to mailbox 22. Protective hoops provide additional protection for mailbox 22 in the event of an otherwise damaging blow to mailbox 22.

Figure 6:
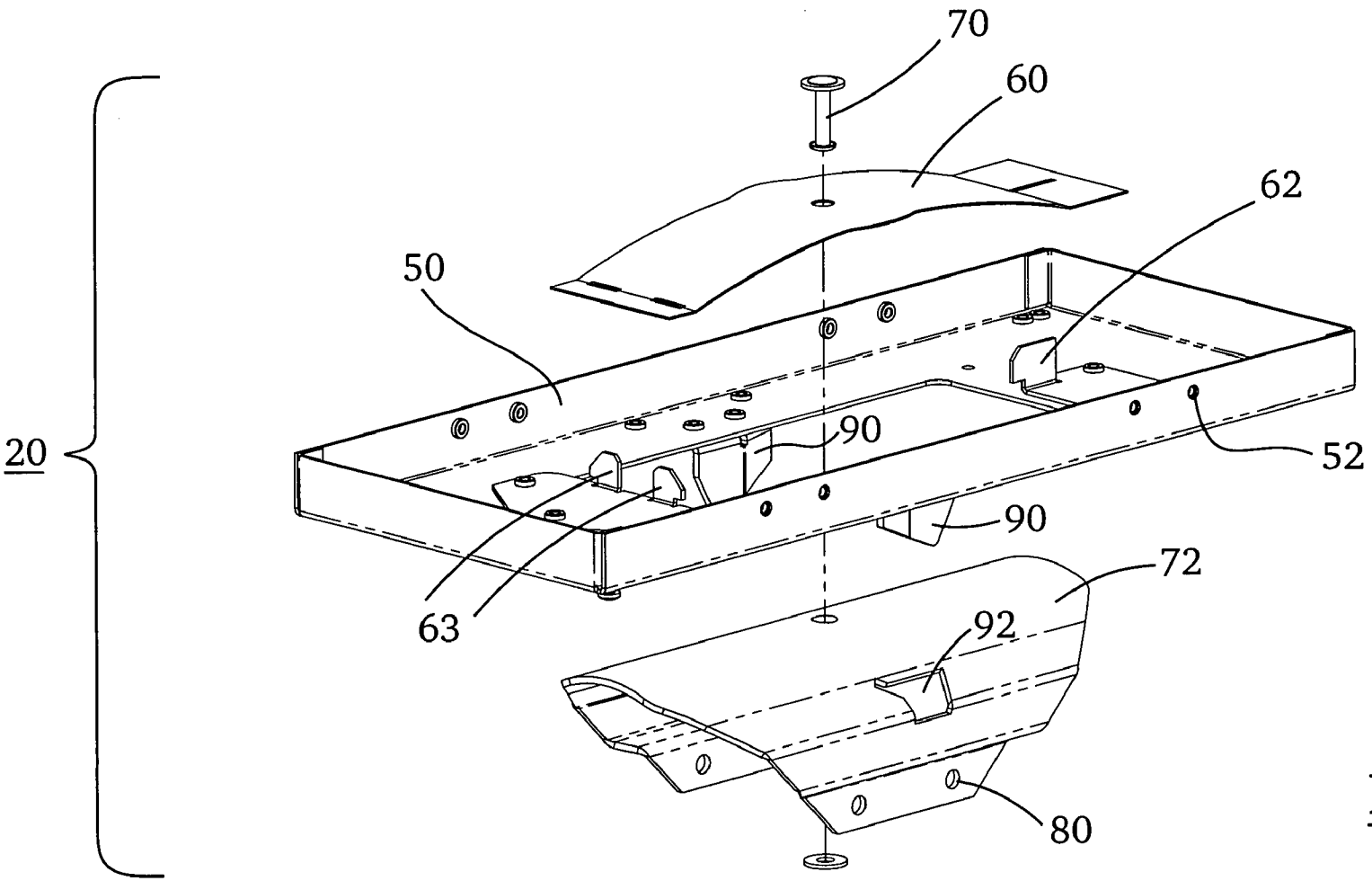
FIG. 6 is an exploded isometric view of the deflector mailbox support system of the present invention.
Figure 7:
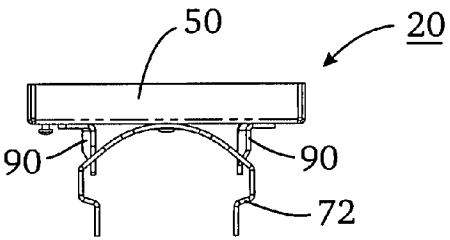
FIGS. 7, 8, 9, and 10 are front elevational, top plan, side elevational, and bottom plan views, respectively, of the deflector mailbox support system of FIG. 6.
Figure 8:
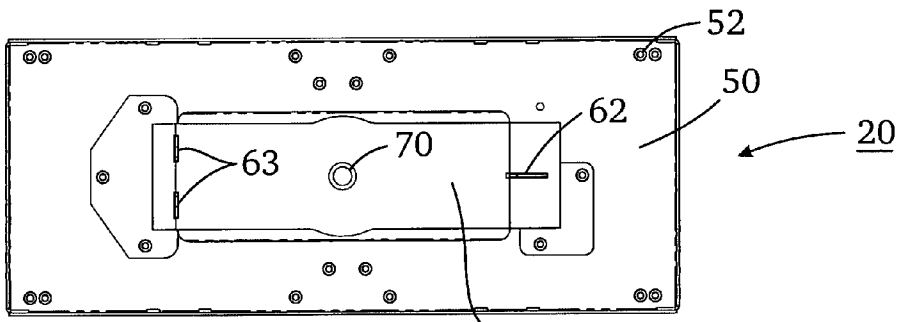
Figure 9:
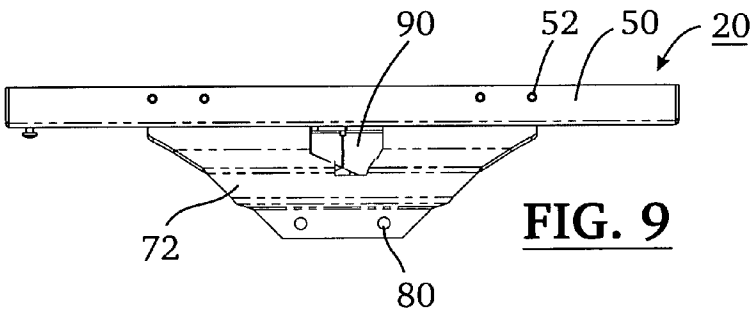
Figure 10:
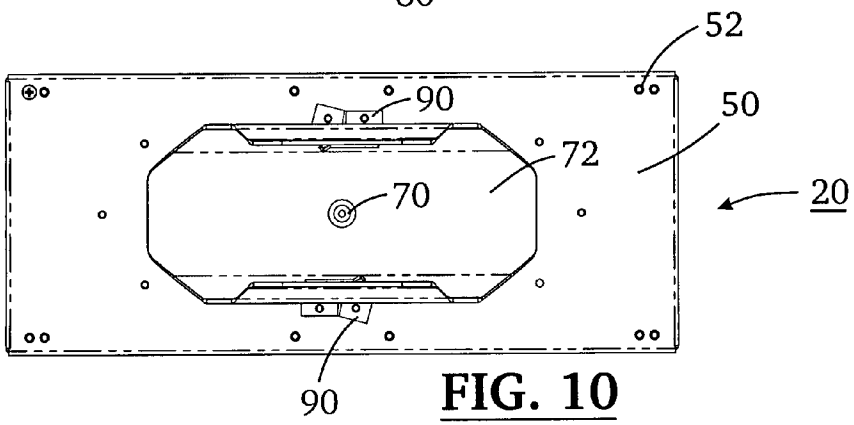

FIG. 6 illustrates the components of deflector mailbox support system 20. Deflector mailbox support system includes a generally horizontal support tray 50 which as attached to mailbox 22 (FIGS. 1–5) by means of screws (none shown on FIG. 6) inserted through holes, as at 52. A generally horizontal pretensioned leaf spring 60 is attached to generally horizontal support tray 50 by means of a vertical post 62 axially aligned with the leaf spring with spaces on either side of the vertical post to allow the leaf spring to flex. A pair of vertical posts 63 athwart the leaf spring hold the other end of the leaf spring to generally horizontal support tray 50. Leaf spring 60 and posts 62 and 63 permit mailbox 22 to move and return to its normal position after an impact. A vertical connection pivot bolt 70 transfers tension of generally horizontal pretensioned leaf spring 60 to post interface bracket 72 and acts as the center pivot. This allows mailbox 22 to rotate when an impact to the mailbox occurs. Post interface bracket 72 is fixedly connected to post 24 or 30 (FIGS. 1–5) by means of screws (none shown on FIG. 6) inserted through holes, as at 80. Leaf spring 60 normally bulges upwardly in its center as shown on FIG. 6.

Deflector mailbox support system 20 can only move horizontally sideways from right to left, rotate upwards, and/or tilt horizontally counterclockwise when facing the opening of the mailbox. This is accomplished by means of pivot bolt 70 and/or two vertical stops 90 fixedly attached to and disposed at the sides of generally horizontal mailbox support tray 50 and extending into two openings 92 (only one visible on FIG. 6) defined in post interface bracket 72.

FIGS. 7–10 illustrate various views of the elements of deflector mailbox support system 20 in assembled relationship.

Figure 11:
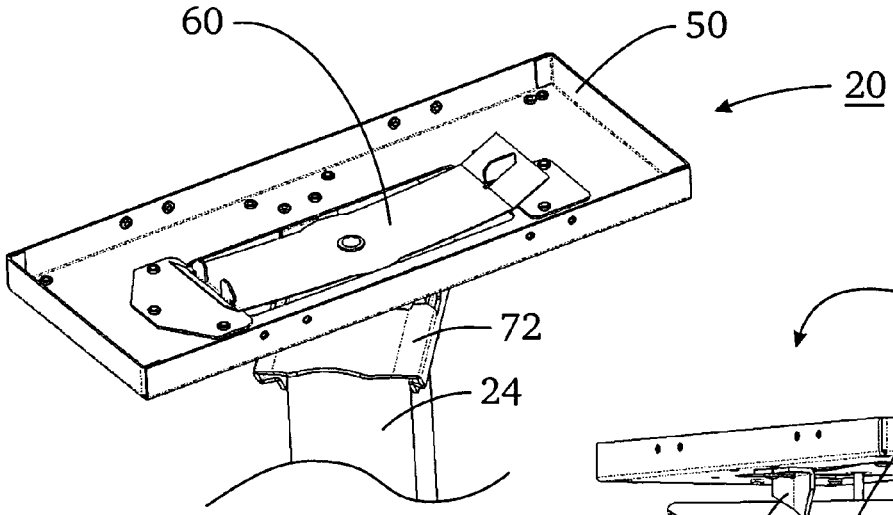
FIG. 11 is a top/front/side elevation isometric view of the deflector mailbox support system of the present invention rotated sideways forty five degrees.
Figure 12:
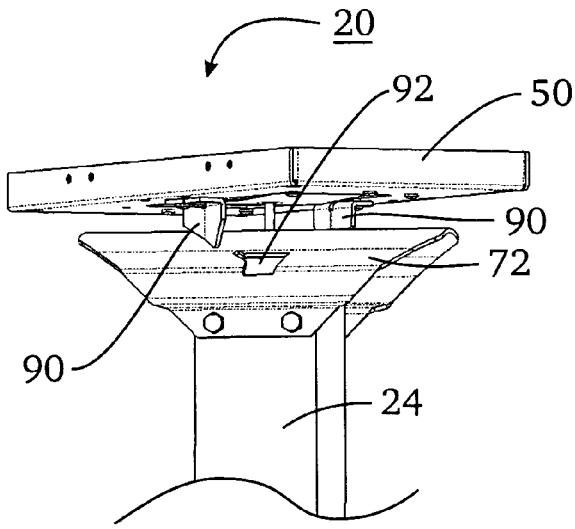
FIG. 12 is a side elevational/rear isometric view of the deflector mailbox support system of the present invention rotated sideways forty five degrees.

FIGS. 11 and 12 show generally horizontal support tray 50 rotated sideways forty five degrees with respect to post interface bracket 72, with leaf spring 60 depressed slightly below the plane of the generally horizontal support tray. If this is the extent of horizontal rotation of generally horizontal support tray 50, mailbox 22 will return to its normal position (FIG. 1) without outside interference, and vertical stops 90 will reengage openings 92.

Figure 13:
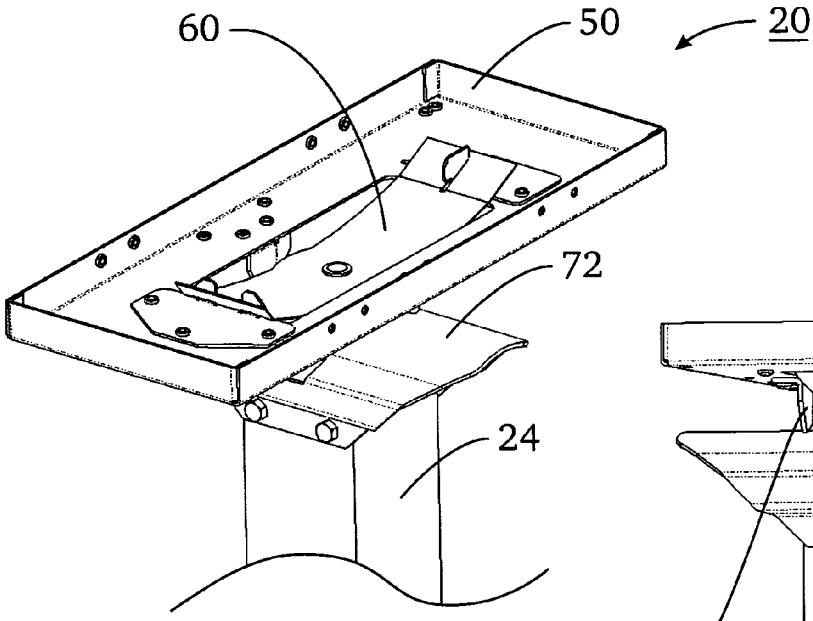
FIG. 13 is a top/front/side elevational view of the deflector mailbox support system of the present invention rotated sideways ninety degrees.
Figure 14:
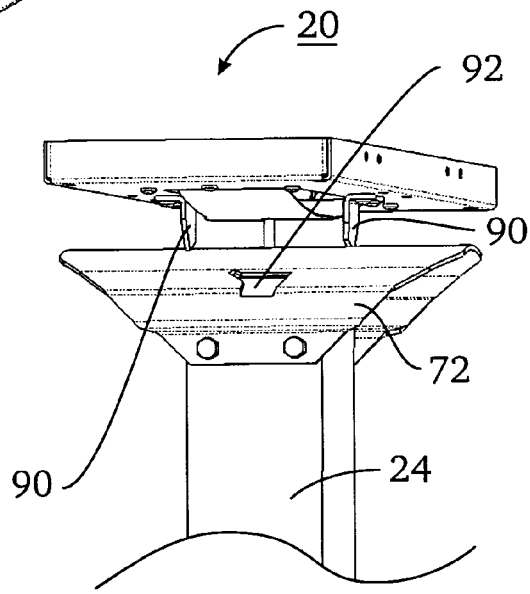
FIG. 14 is a side elevational/rear isometric view of the deflector mailbox support system of the present invention rotated sideways ninety degrees.

FIGS. 13 and 14 show generally horizontal support tray 50 rotated horizontally sideways ninety degrees with respect to post interface bracket 72, with leaf spring 60 depressed well below the plane of the generally horizontal support tray. In this position, deflector mailbox support system 20 is in a condition of unstable equilibrium and a slight amount of counterclockwise force, viewed from above mailbox 22, will return the mailbox to its normal position (FIG. 1) or a slight amount of clockwise force will cause the mailbox to assume a position one hundred eighty degrees from its position shown on FIG. 1. In this rotated position, a small amount of clockwise force will return the mailbox to the position shown on FIG. 1.

Figure 15:
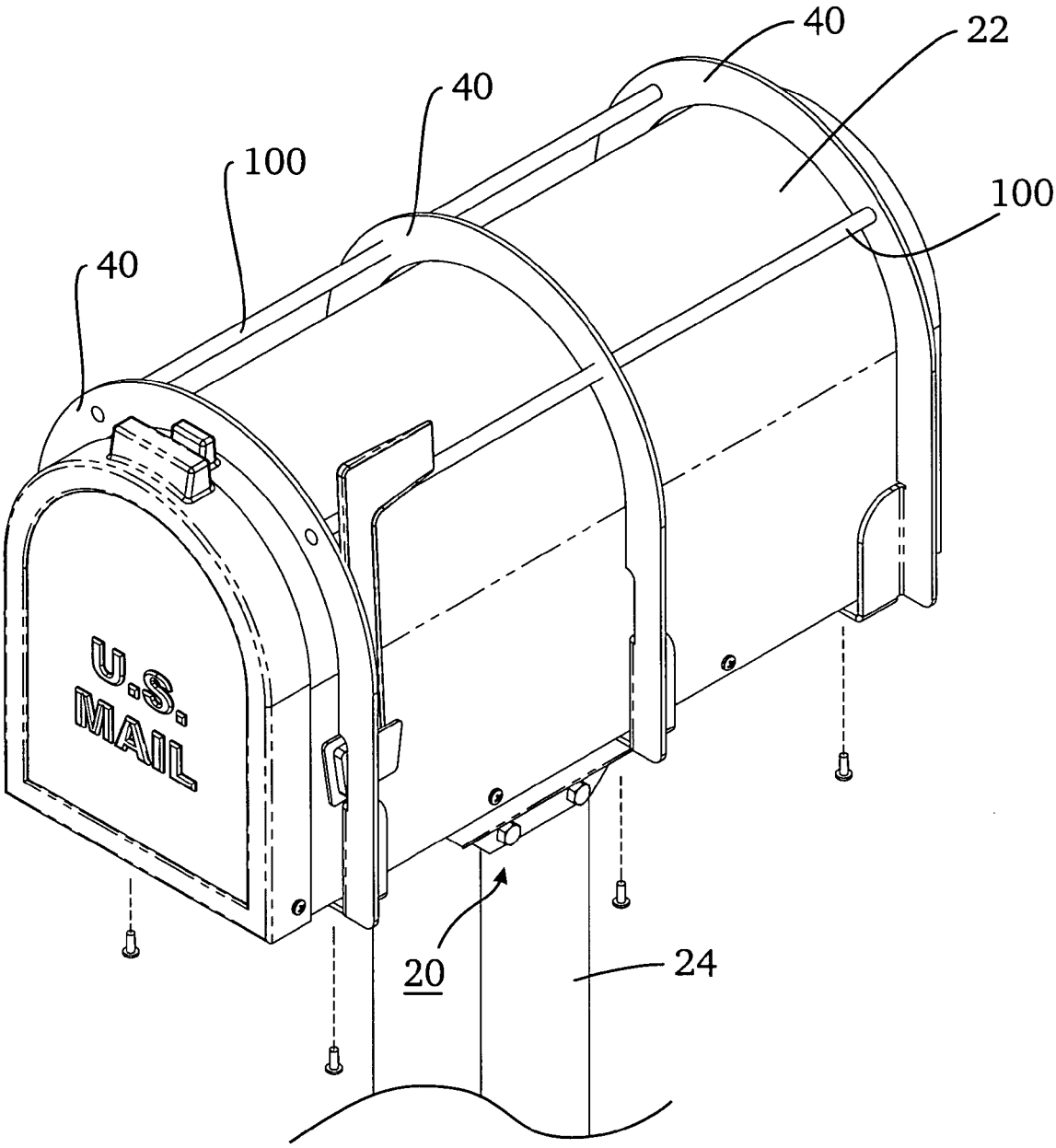

FIG. 15 illustrates two bracing arms 100 fixedly attached to protective hoops 40 near the upper portions of the protective hoops. Bracing arms 100 serve to further reinforce mailbox 22 from damaging blows.

Figure 16:
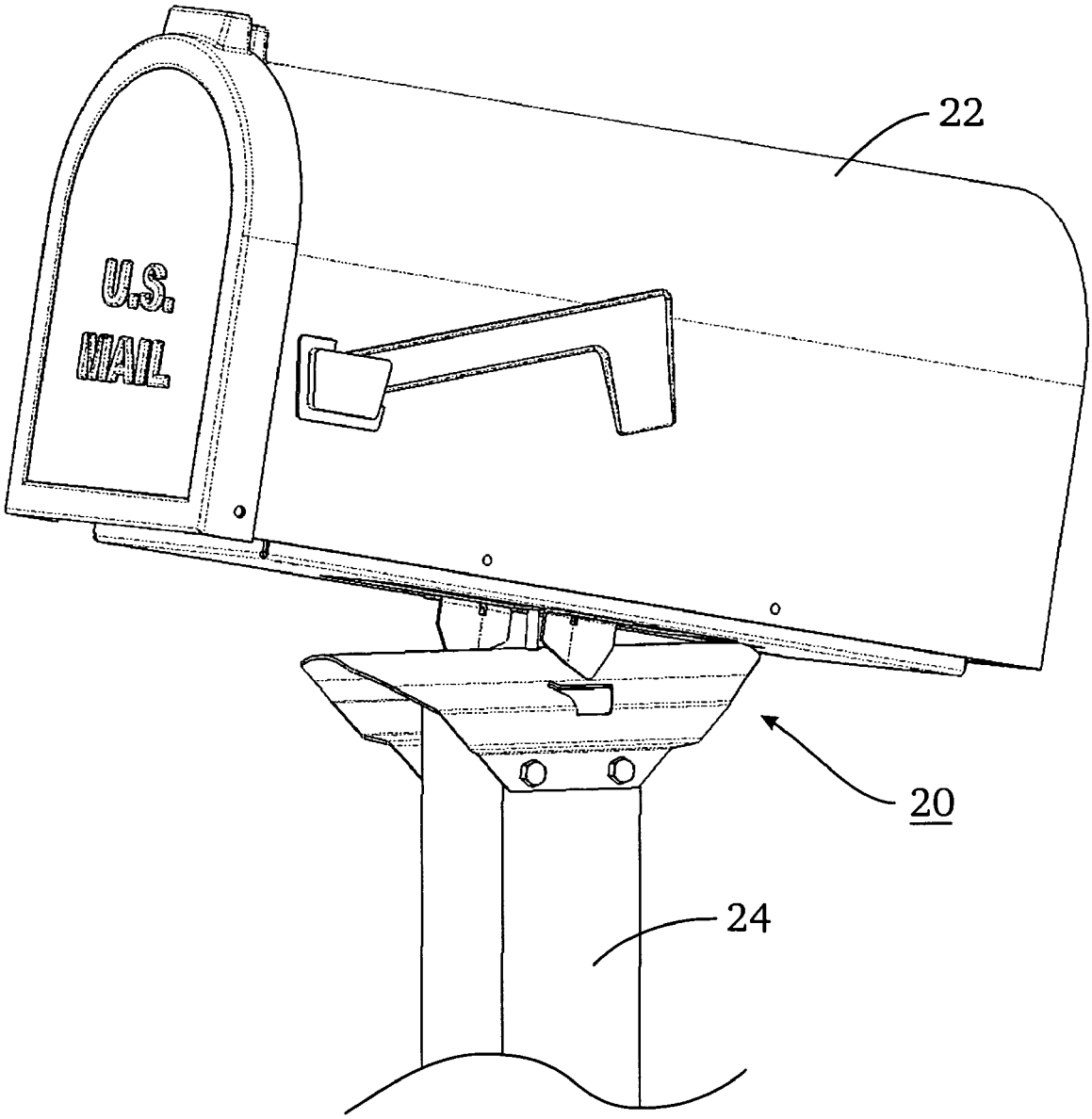
FIG. 16 is a top/front/bottom isometric view of the mailbox rotated upwardly.

FIG. 16 illustrates mailbox 22 rotated upwardly as viewed from the mail dispensing end of the mailbox. It will be understood that mailbox 22 will return to its normal position (FIG. 1), or deflector support system 20 will assume the positions shown on FIGS. 11–14 if the blow causes the deflector support system to horizontally rotate. In the latter case, mailbox 22 can be returned to its normal position (FIG. 1).

Figure 17:
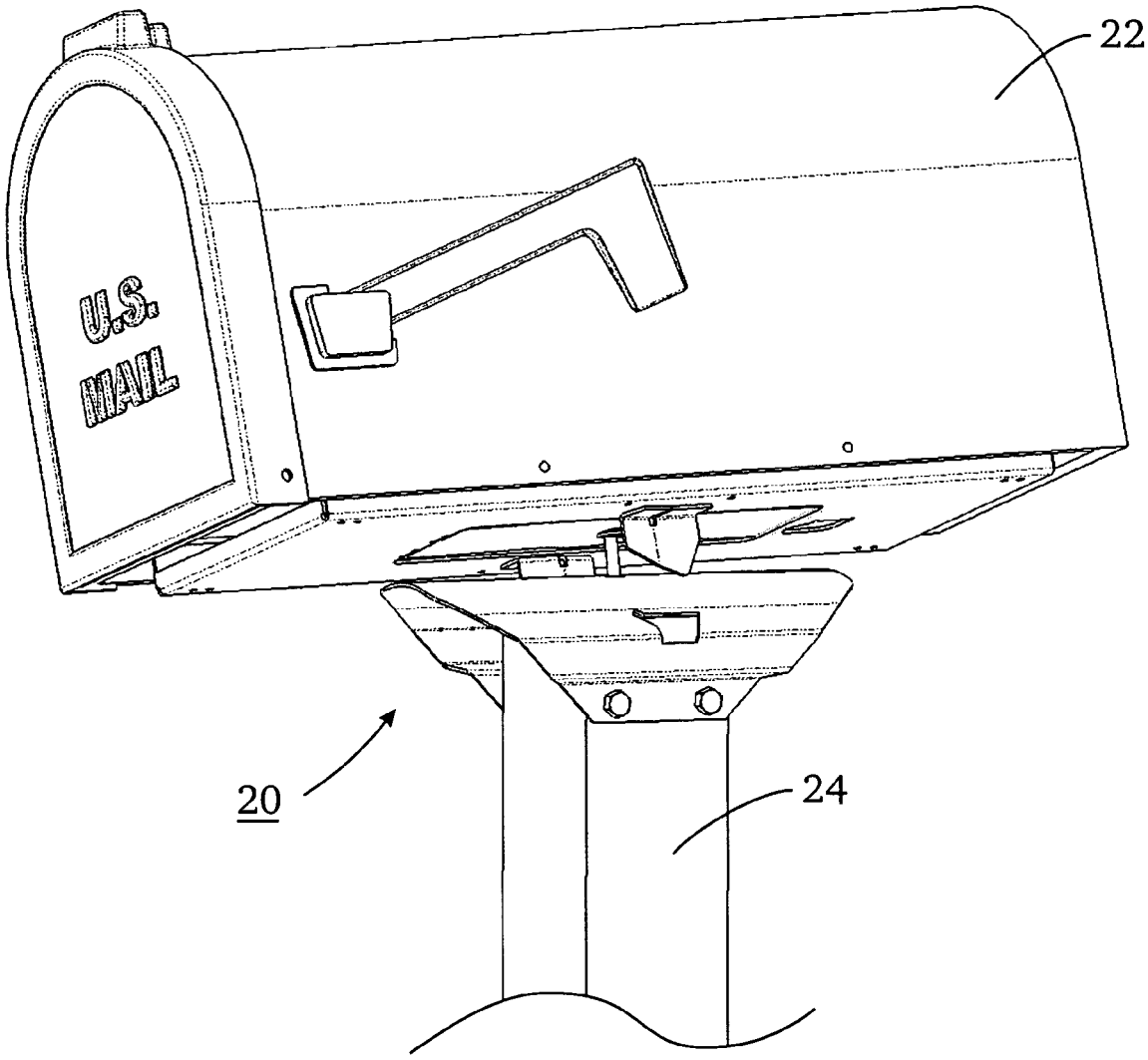
FIG. 17 is a top/front/bottom isometric view of the mailbox titled sideways.

FIG. 17 illustrates mailbox 22 tilted horizontally counterclockwise by the blow. It will be understood that mailbox 22 will return to its normal position (FIG. 1), or deflector support system 20 will assume the positions shown on FIGS. 11–14 if the blow causes the deflector mailbox support system to horizontally rotate. In the latter case, mailbox 22 can be returned to its normal position (FIG. 1).

To the extent the blow causes deflector support system 20 to rotate upwardly and/or to tilt horizontally counterclockwise, viewed from the mail dispensing end of mailbox 22, leaf spring 60 will be depressed downwardly a degree depending on the severity of the blow. Mailbox support system 20 can then assume a sideways rotated position as shown, for example, on FIGS. 11–14.

On a prototype, the forces to cause deflector support system 20 to rotate horizontally sideways varied between two and five pounds. This was measured by the force at the leading edge of mailbox 22 to cause deflector support system to rotate horizontally sideways, slowly without momentum affecting the measurement. Initially, the rotation force was three to four pounds, then after about ten degrees of rotation, the force increased to about five pounds, and then dropped to about two or three pounds for the rest of the travel. Of course, deflector support system 20 can be designed to require more or less force to rotate the deflector support system.

The major elements of deflector mailbox support system 20 can be constructed of heavy gauge steel folded and welded together. Likewise, protective hoops 40 and bracing arms 100 can be constructed of the same material. If desired, the assembly can be galvanized for greater protection. Of course, other suitable materials of construction can be employed.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. An apparatus, comprising:

(a) a generally horizontal support tray to support a mailbox;

(b) a post interface bracket for attachment to a mailbox support post;

(c) a spring attached to said generally horizontal support tray and disposed so as to return said generally horizontal support tray to its normal position after said generally horizontal support tray is rotated out of position wherein said spring is a pretensioned leaf spring having a center thereof which is movable above and below said generally horizontal support tray when said generally horizontal support tray is rotated; and (d) a connection pivot bolt connecting said spring and said post interface bracket, said connection bolt being sole method of attachment of said generally horizontal support tray and said post interface bracket.

2. An apparatus, as defined in claim 1, wherein: said generally horizontal support tray can rotate sideways from right to left, can rotate upwardly, and can tilt when said generally horizontal support tray is viewed from a mail-receiving end of said mailbox.

3. An apparatus, as defined in claim 2, wherein: motion of said generally horizontal support tray is confined by engagement of at least one vertical stop fixedly attached to and depending from said generally horizontal support tray and an opening defined in said post interface bracket.

4. An apparatus, as defined in claim 1, wherein: when said generally horizontal support tray is rotated sideways less than ninety degrees, said generally horizontal support tray is adapted to automatically return to its normal position when said rotating force is removed.

5. An apparatus, as defined in claim 1, wherein: said center of said pretensioned leaf spring is above said generally horizontal support tray when said generally horizontal support tray is in its normal position.

6. An apparatus, as defined in claim 1, wherein: when said generally horizontal support tray is rotated sideways approximately forty-five degrees, said center of said pretensioned leaf spring is about even with said generally horizontal support tray.

7. An apparatus, as defined in claim 1, wherein: when said generally horizontal support tray is rotated sideways approximately ninety degrees, said center of said leaf spring is below said generally horizontal support tray.

8. An apparatus, as defined in claim 1, wherein: a center of said post interface bracket defines a horizontal, smooth, inverted channel having an axis parallel to a major axis of said generally horizontal support tray.

9. An apparatus, as defined in claim 1, further comprising: protective hoops attached to said generally horizontal support tray and disposed over said mailbox.

10. An apparatus, as defined in claim 9, further comprising: bracing arms fixedly attached to said protective hoops.

* * * * *